United States Patent [19]

Booth et al.

[11] 4,247,982

[45] Feb. 3, 1981

[54] SKIN-FLOW CONTROL RAZOR

[75] Inventors: Anthony R. Booth, Orange; Cyril A. Cartwright, Monroe, both of Conn.

[73] Assignee: Warner-Lambert Company, Morris Plains, N.J.

[21] Appl. No.: 26,160

[22] Filed: Apr. 2, 1979

[51] Int. Cl.[3] ..... B26B 21/06; B26B 21/40

[52] U.S. Cl. ..... 30/41; 30/47; 30/83

[58] Field of Search ..... 30/34.2, 41, 47, 83

[56] References Cited

U.S. PATENT DOCUMENTS

| | | | |
|---|---|---|---|
| 2,699,602 | 1/1955 | Finley | 30/47 |
| 2,741,840 | 4/1956 | Brophy | 30/83 X |
| 3,871,073 | 3/1975 | Nissen | 30/34.2 |

FOREIGN PATENT DOCUMENTS

| | | | |
|---|---|---|---|
| 1045365 | 1/1979 | Canada | 30/34.2 |
| 1140837 | 12/1962 | Fed. Rep. of Germany | 30/34.2 |

*Primary Examiner*—Gary L. Smith

*Attorney, Agent, or Firm*—Jeremiah J. Duggan; Louis S. Gillow

[57] ABSTRACT

A shaving assembly is provided with skin-flow control means positioned in advance of the blade edge to control the effective exposure and blade-to-skin angle of the blade edge so as to greatly minimize or eliminate nicking. The skin-flow control means serves to minimize or eliminate the skin bulges which may otherwise be created in the unsupported space between a razor guard element and the blade edge. The skin-flow control means is provided by extending the skin-supporting surface of the guard element into such close proximity with the blade edge that the formation of a skin bulge therebetween is substantially prevented. A plurality of small holes may be provided in the guard element near the blade edge for allowing water flow therethrough to rinse shaving debris from the region of the blade.

12 Claims, 6 Drawing Figures

SKIN-FLOW CONTROL RAZOR

The present invention relates to safety razors, and more specifically to the geometry of safety razors. More specifically still, the invention is concerned with the guard structure of safety razors.

Most safety razors have as their major purpose the provision of a close yet safe shave. "Closeness" is a relative term and may be perceived differently by different individuals; however, "safety" generally means the absence of nicks and cuts of the skin, particularly those which cause blood to flow. The guard structure and, to some extent, the cap or cover structure present in a safety razor serve the important functions of at least partially orienting the razor blade relative to the skin and limiting the exposure of the blade. In these roles, conventional guard structures have typically comprised an elongated member with a skin-engaging surface extending parallel to and positioned in front of the cutting edge of the blade. The skin-engaging surface of the guard has typically been spaced from the blade edge by a distance between about 1 mm (0.040 inch) and 2 mm (0.080 inch), termed the "span", with essentially no means for supporting the skin therebetween. Further, the exposure of the blade has conventionally been defined as the perpendicular distance to the blade edge from the plane tangent to the cap and guard.

While the "closeness" and "safety" of the shaves provided by many commercially available safety razors is generally considered acceptable, the occasional occurrence of nicking suggests that a further improvement in "safety" is desirable. Some prior art safety razors have sought to reduce nicking by providing guard elements directly on the cutting edge of the blade or, as in U.S. Pat. No. 3,722,090, by creating ridges spaced along the upper surface of the guard bar in a manner suggestive of the guard elements placed on the blade. While it is the stated intent of that patent that the raised ridges not be so close as to "pinch" the skin therebetween, there is only minimal improvement in the reduction of nicking, possibly because of the 3.8 mm (0.150+ inch) spacing between ridges.

Another effort to reduce nicking is disclosed in U.S. Pat. No. 3,735,486. There it was submitted that a "roll" of skin forms between the guard and the blade edge, producing a relatively high attack angle of the blade relative to the skin such that excessive nicking occurs. In an effort to reduce the skin "roll", a small bead guard was placed on the trailing facet of the blade to coact with the conventional guard in a manner purportedly resulting in the stretching or straightening of the skin to reduce or eliminate the roll.

In addition to the skin roll or bulge at the blade edge causing a change in the blade-to-skin angle, it may also increase the effective "exposure" of the blade if it extends inwardly or rearwardly of the plane tangent to the cap and guard.

Therefore, it is a principal object of the present invention to provide a shaving unit with a diminished propensity to nick and cut. Included in this object is the provision of such improved means in a relatively economical manner.

SUMMARY OF THE INVENTION

In accordance with the present invention skin-flow control means are provided in advance of the blade edge to control the effective exposure and blade-to-skin angle of the blade edge so as to greatly minimize or eliminate nicking. The compliance of human skin, while great enough to allow the objectionable "bulges" with razors having large unsupported "spans", is also sufficiently limited that little or no "bulge" occurs if the unsupported "span" is small. Thus there is provided a shaving cartridge assembly having a seat member with a blade seat thereon; one or more blades supported on the blade seat with cutting edges along the respective front margins; a cap member and post arrangement, or the like, for retaining the blade(s) in position on the blade seat; and an elongated guard element positioned in advance of and extending longitudinally substantially parallel to the blade cutting edge(s), the guard element having a skin-engaging control surface of sufficient area along its length and positioned sufficiently close to said blade cutting edge that insufficient skin may enter any unsupported area therebetween to allow nicking of the skin.

The skin-engaging surface of the guard may be continuous, or substantially continuous, and may be planar or of some non-linear geometry, the basic requirement being that a sufficient area of the guard exists in a region sufficiently close to the blade edge for controlling the flow or contour of skin such as to substantially eliminate nicking due to skin bulges in the proximity of the blade edge which increase the effective blade-to-skin angle and/or the effective exposure.

In a preferred embodiment, the guard includes a relatively large planar surface extending rearwardly from well forward of the blade to a position closely adjacent the edge. Moreover, a series of small apertures in the guard near the blade edge provide for removal of shaving debris. The size and position of the apertures is controlled to minimize any skin bulge thereinto.

Advantage may also be taken of the fact that the dermal blood vessels of the skin which may cause bleeding if "nicked" are covered by an epidermal layer which contains no blood vessels and may be about 0.05 mm (0.002 inch) thick. Nicking, at least to the extent that bleeding is caused, may be absolutely avoided by ensuring that the blade cannot penetrate deeper into the skin than the epidermal layer. If, in the interest of increasing shave closeness, it is desirable to increase the blade exposure, such may be done in accordance with the present invention with relatively little sacrifice of safety.

DESCRIPTION OF THE PREFERRED EMBODIMENTS

Figure 1:
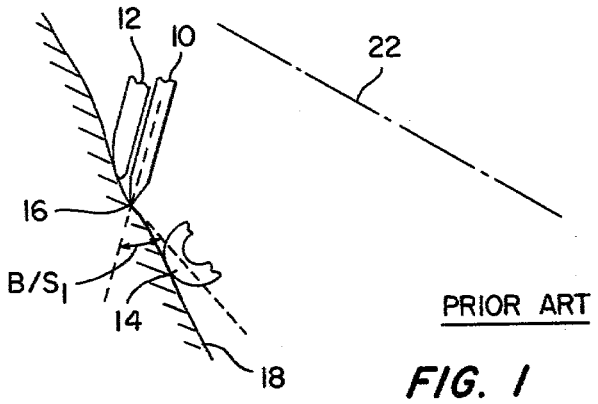
FIG. 1 is an enlarged schematic illustration of a conventional prior art shaving assembly disposed in an optimal orientation relative to the skin.

Referring to FIG. 1, a conventional prior art shaving assembly of the cartridge type or otherwise is diagrammatically illustrated as comprising a blade 10, a cap 12, and a skin-engaging guard 14 having a curved surface. Guard 14 is generally supported by a seat member (not shown). The longitudinally extending edge 16 of blade 10 is shown in engagement with skin 18 for shaving whiskers (not shown). Typically, the distance from the blade edge or apex 16 to the tangent point on the curved surface of guard 14 is about 1 –2 mm (0.040–0.080 inch), and is termed the "span". Normally the guard's curved surface is of relatively small radius such that it does not support the skin in the "span" region. Further, the tangent angle of blade 10 is between about 15° and 40°, with 20° to 30° being preferred, that being the angle the blade makes with a line from edge 16 tangent to guard 14. The cap 12 may provide another skin-engaging surface, and the "exposure" of blade 10 is the perpendicular distance to edge 16 from a line tangent to cap 12 and guard 14. A handle, represented by center line 22, is connected to and extends from the blade assembly usually at a predetermined angle.

In an optimum situation, the user holds the handle at a particular angle and/or with a particular pressure relative to skin 18 such that the blade 10 makes a preferred angle relative to the skin, that angle being designated $B/S_1$ in FIG. 1 and initially determined by the blade edge-guard tangent angle. In order to adequately cut hairs or whiskers from skin 18, yet avoid nicking the skin, it is desirable that the blade-to-skin (B/S) angle be neither too low (at or near parallel) nor too high (at or near perpendicular), the former being ineffective for cutting hair due to skipping and the latter being inclined to scrape and cause bleeding.

Figure 2:
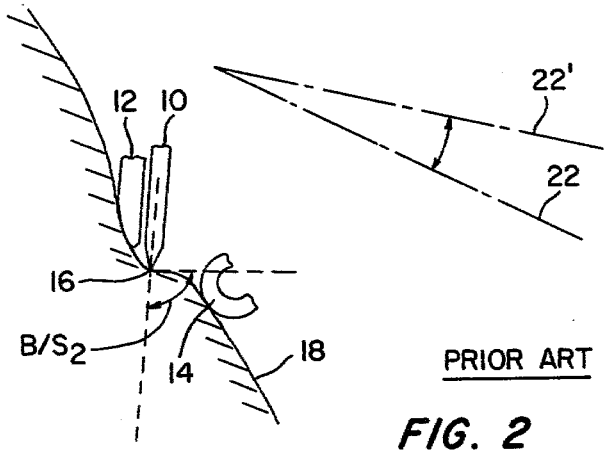
FIG. 2 illustrates the prior art shaving assembly of FIG. 1 in an orientation with the skin which may result in nicking.

However, if the user applies increased pressure from blade 10 toward skin 18, possibly by pivoting the handle relatively upward from blade 10 (as illustrated by 22' in FIG. 2), the skin bulges into the span between the blade and guard 14, as shown in FIG. 2. The bulge or roll may also be contributed to by a "plowing" effect of the blade 10 as it is drawn across the skin. This skin bulge increases the effective exposure of the blade and increases the effective blade-to-skin angle to $B/S_2$ which may approach or even be greater than 90°, such that the edge 16 is directed into the skin and with increased "effective" exposure is likely to cut and cause bleeding.

As discussed earlier, certain prior art techniques attempting to reduce nicking have applied arcuate ridges to the guard bar at spaced intervals along its length in an effort to aid in "smoothing and stretching" the skin. Also, a skin-stretching bead has been applied to the trailing facet of a blade to aid in "stretching" the skin and thereby reduce any "bulges" which might otherwise appear in the open span between the guard and blade edge.

Figure 3:
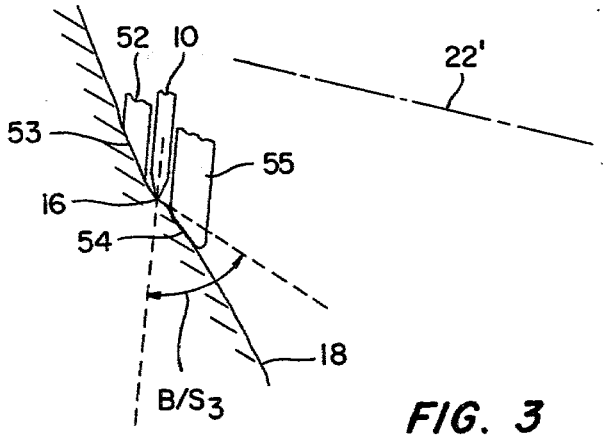
FIG. 3 is an enlarged schematic illustration of a shaving assembly according to the invention in operative engagement with the skin.
Figure 5:
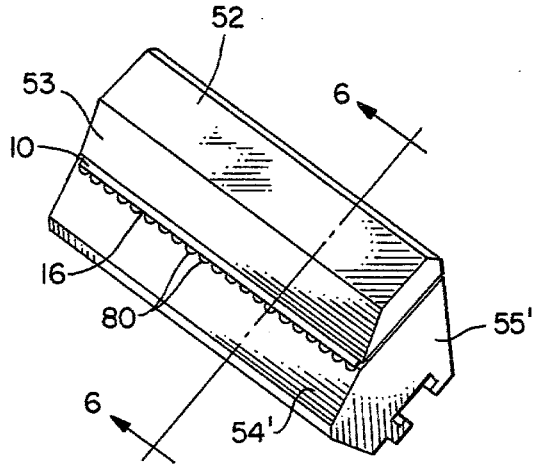
FIG. 5 is a perspective view of a shaving assembly in accordance with another embodiment of the invention.
Figure 4:
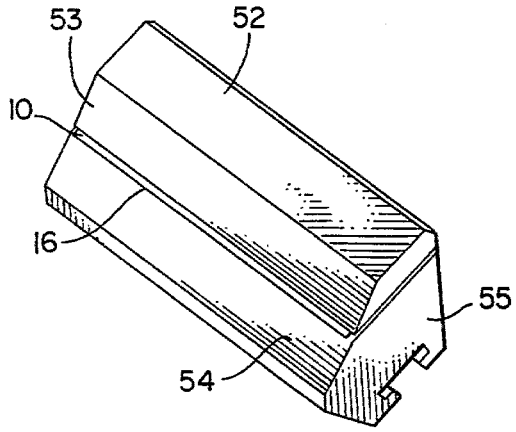
FIG. 4 is a perspective view of a shaving assembly in accordance with one embodiment of the invention.
Figure 6:
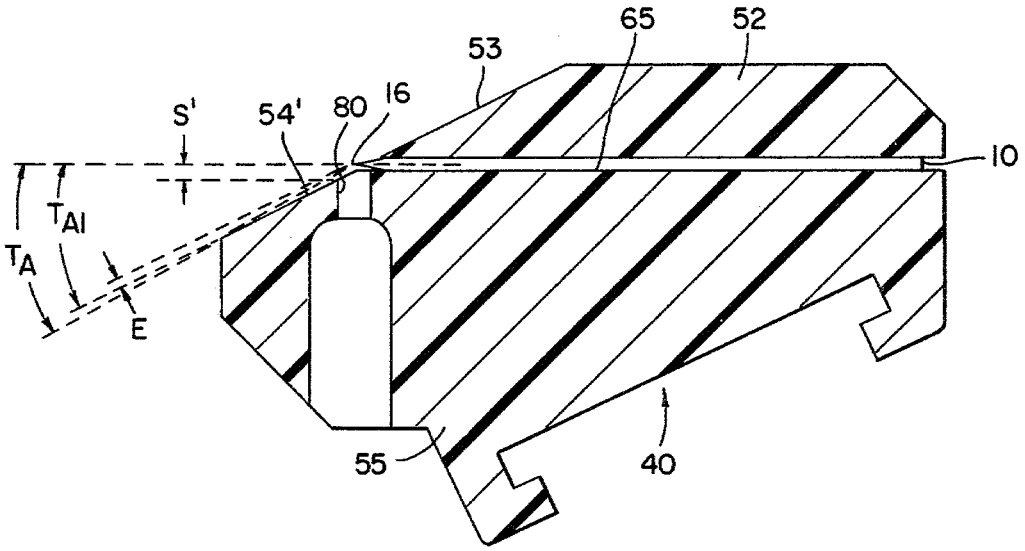
FIG. 6 is an enlarged sectional view of the shaving assembly of FIG. 5 taken along lines 6—6 thereof.

However, in accordance with the present invention, as diagrammatically illustrated in FIG. 3 and in greater detail in FIGS. 4–6, the conventional guard structure is replaced with a novel skin-engaging control or guard surface 54 which is preferably an integral portion of a seat 55. Additionally, the skin-engaging surface 53 of cap 52 may also be of modified form. With this novel structure, a substantially constant blade/skin angle $B/S_3$ can be maintained under varying conditions of handle angle and/or blade pressure, that angle being approximately the same as $B/S_1$. Similarly, the effective exposure can be maintained relatively constant.

Specifically, the guard surface 54 is a substantially continuous surface, preferably but not necessarily planar, extending rearwardly from a position well below or in advance of blade edge 16 about 2.5 mm (0.1 inch) to a position closely adjacent that edge. More specifically, the guard surface 54 extends to within about 0.75 mm (0.030 inch) of the blade edge 16, and preferably closer, over substantially their entire mutual longitudinal extents.

In the preferred embodiments, the guard surface 54 is planar and extends to a position which is less than 0.25 mm (0.010 inch) from blade edge 16, that guard surface being continuous in the embodiment of FIG. 4, and being substantially continuous in the embodiment of FIGS. 5 and 6, with small "rinse" holes being provided therein in the region of the blade edge.

The novel blade assembly is preferably, though not necessarily, in the form of a bonded cartridge. Seat 55 is of plastic and includes an upper planar surface 65 providing a support platform for the blade 10. The blade assembly may be operatively connected with a handle (not shown) in any of a variety of manners, as for instance by engagement of the channel 40 in seat 55 with a complementary channel member on the handle. The cap 52 is of plastic and overlies blade 10 and includes binding posts (not shown) extending through openings (not shown) in the blade and seat 55 for retaining the blade and seat, with guard surface 54, as an integral unit in a well known manner.

In the preferred embodiments, the cap 52 also includes a planar skin-engaging surface 53 extending rearward about 2.5 mm (0.100 inch), more or less, from near blade edge 16 in substantially the same plane as guard surface 54.

The guard surface 54 is at an angle of about 25° to the line bisecting the apex angle of edge 16 and is designated $T_{A1}$ herein. The blade 10 in the present embodiments has a thickness of about 0.25 mm (0.010 inch), though other thicknesses such as 0.1 mm (0.004 inch) may be used as well. In accordance with the invention, the skin-supporting surface 54 of the guard is in such close proximity with the blade edge 16 that the skin is supported adjacent the blade edge at a relatively constant blade/skin angle $B/S_3$ and is prevented from creating a "bulge" that could increase the effective blade/skin angle and the effective exposure to the extent needed for nicking.

To minimize nicking, the blade exposure E should be as small as possible yet sufficient to provide shaves of acceptable closeness. The exposure E of blade 10 is the perpendicular distance to blade edge 16 from a line tangent to both the skin-engaging guard surface 54 and cap surface 53. An exposure of about +0.05 mm (+0.002 inch) absolutely prevents nicking which can bleed because an epidermal skin layer without blood vessels and being typically about 0.05 mm (0.002 inch) thick on the face overlies the dermal blood vessels of the skin. An exposure of about +0.13 mm (+0.005 inch) has exhibited a good combination of "nick-free" operation and close shaving characteristics, and is presently preferred, though it will be appreciated that exposures in the range of +0.025 to 0.2 mm (+0.001 to 0.008 inch) will offer varying degrees of acceptability to differing shavers.

Using the conventional measurement of span, the present blade assembly exhibits a distance of nearly 2.5 mm (0.100 inch) from the blade edge 16 to the tangent point at the forwardmost or lowermost end of guard surface 54, which of course is greater than most prior art assemblies. However, whereas the prior art assemblies generally provide no support to the skin over the interval of the "span", the present assembly supports the skin over substantially the full extent of guard surface 54 from its forward tangent point rearward to within about 0.25 mm (0.010 inch) of blade edge 16 because it is substantially continuous over that "span" and recedes from the tangent line (plane) between the conventional tangent point and blade edge 16 by only about the extent of the blade exposure, i.e., 0.13 mm (0.005 inch).

In the present instance, blade 10 is 0.25 mm (0.010 inch) thick and guard surface 54 extends to a point coincident with the plane of the lower surface of that blade and 0.13 mm (0.005 inch) behind edge 16. Thus, because the skin is supported so near the tangent plane (within about 0.13 mm (0.005 inch) in the region of the blade edge 16, it hasn't the opportunity to "bulge" and create the relatively large blade/skin angles and effective exposures which can result in nicking.

In an alternate embodiment of the invention, as illustrated in FIGS. 5 and 6, the blade assembly is the same as described above with the exception that a series of rinse holes or passages 80 are formed in guard surface 54' near blade 10 and extend downwardly through seat 55'. Rinse holes 80 are arrayed in guard surface 54' at evenly spaced intervals along a line extending parallel to blade edge 16. The rinse holes 80 are preferably as small in diameter as possible at guard surface 54' and yet sufficient to allow effective flow therethrough of shaving debris including hair or whisker cuttings. A hole diameter of 1 mm (0.040 inch) at guard surface 54' has been found to provide effective rinsing of shaving debris resulting from a two-day growth of whiskers. The diameter of holes 80 may be substantially increased and/or may enter a large plenum beneath surface 54', as illustrated in FIG. 6.

The center-to-center spacing of holes 80 is such as to provide a relatively large number of rinse passages yet also retain some skin-supporting surface therebetween. The centers of successive 1 mm (0.040 inch) diameter holes 80 are here spaced at about 2.1 mm (0.085 inch) intervals.

Further, holes 80 are positioned as far rearward as possible, relative to blade edge 16 so as to minimize the portion of the holes which occupy the otherwise skin-supporting surfaces of guard surface 54'. In the present embodiment, the inclined grind and hone surfaces of blade 10 which form edge 16 extend rearward from that edge about 0.64–0.75 mm (0.025–0.030 inch) before encountering the blade supporting surface 65 of seat 55'. With a blade exposure of +0.125 mm (+0.005 inch) and guard surface 54' making an angle $T_{A1}$ of about 25° with the bisector of the blade edge apex angle, the local "span" S' from edge 16 to the forwardmost extremity of a hole 80 is less than 0.75 (0.030 inch). Additionally, the conventional tangent angle $T_A$ is nearly the same as , $T_{A1}$being about 26°. Although a hole 80 creates an elongated void in the skin-supporting surface of approximately 1 mm (0.040 inch) in length parallel to and proximate to blade edge 16, the circular shape of that hole generally reduces that dimension parallel to the blade as the distance forward from edge 16 along guard surface 54' is increased. Additionally, a somewhat longer void may be tolerated in the direction parallel to blade edge 16 than in the direction transverse thereto as it is the latter direction which is in line with razor motion and principally determines blade/skin angles and, to some extent, effective exposure.

While two specific alternate embodiments have been described, it will be appreciated that certain variations therein are clearly within the scope and intent of the invention.

We claim:

1. A shaving assembly comprising:

a blade supporting member having a support platform thereon;

a razor blade positioned on said support platform, said blade having a cutting edge along the forward margin thereof;

means retaining said blade in position on said support platform; and an elongated guard element positioned in advance of and extending longitudinally substantially parallel to said blade cutting edge, said guard element having a substantially planar skin-engaging control surface and a plurality of small holes extending therethrough and arrayed along the length of said skin-engaging control surface closely adjacent said blade cutting edge for allowing flow of cleansing liquid therethrough, said skin-engaging control surface being of sufficient area along its length and positioned sufficiently close to said blade cutting edge that any skin entering any unsupported area therebetween is substantially insufficient to allow nicking of the skin.

2. The shaving assembly of claim 1 wherein the maximum distance between said blade edge and said skin-engaging control surface over which the skin therebetween is unsupported is less than about 0.75 mm (0.030 inch).

3. The shaving assembly of claim 2 wherein said blade retaining means includes cap means, said cap means having a substantially planar skin-engaging control surface positioned rearwardly of and extending parallel to said blade cutting edge.

4. The shaving assembly of claim 3 wherein said skin-engaging control surfaces of said guard element and said cap means respectively are substantially coplanar.

5. The shaving assembly of claim 4 wherein the exposure of said blade cutting edge is less than about +0.125 mm (+0.005 inch) measured normal to a line tangent to both said guard element and cap means skin-engaging control surfaces.

6. The shaving assembly of claim 2 wherein the maximum distance between said blade edge and said skin-engaging control surface over which the skin therebetween is unsupported is less than about 0.25 mm (0.010 inch).

7. The shaving assembly of claim 1 wherein said flow holes are substantially circular and have respective diameters of about 1 mm (0.040 inch) at said skin-engaging control surface.

8. The shaving assembly of claim 7 wherein said flow holes are arrayed at evenly spaced intervals in the skin-engaging control surface, the spacing between centers of successive flow holes being about 2.1 mm (0.085 inch).

9. The shaving assembly of claim 8 wherein said skin-engaging control surface is substantially planar and extends to within less than 0.25 mm (0.010 inch) of said blade cutting edge and said flow holes are positioned therein such that no portion thereof at their intersections with said skin-engaging control surface is greater than about 0.75 mm (0.030 inch) from said blade cutting edge.

10. The shaving assembly of claim 1 wherein said blade retaining means includes cap means having a skin-engaging surface positioned rearwardly of and extending parallel to said blade cutting edge and the exposure of said blade cutting edge is less than about +0.125 mm (+0.005 inch) measured normal to a line tangent to both said guard element skin-engaging control surface and said cap means skin-engaging surface.

11. The shaving assembly of claim 1 wherein said skin-engaging control surface extends at least to within about 0.25 mm (0.010 inch) of said blade cutting edge.

12. The shaving assembly of claim 1 wherein the maximum width of each of said small holes in said skin-engaging control surface measured parallel to said blade cutting edge is about 1 mm (0.040 inch).

* * * * *